US006405668B1

(12) United States Patent
Corlett

(10) Patent No.: US 6,405,668 B1
(45) Date of Patent: Jun. 18, 2002

(54) LOW FRICTION BOOM TO SHEET ATTACHMENT FOR SAILBOAT

(76) Inventor: Edwin H. Corlett, 111 Lawndale Ave., Elmhurst, IL (US) 60126

( * ) Notice: Subject to any disclaimer, the term of this patent is extended or adjusted under 35 U.S.C. 154(b) by 0 days.

(21) Appl. No.: 09/680,100

(22) Filed: Oct. 6, 2000

(51) Int. Cl.[7] ..... B63B 15/00
(52) U.S. Cl. ..... 114/97; 114/113
(58) Field of Search ..... 114/89, 90, 91, 114/102.1, 109, 111, 113, 97

(56) References Cited

U.S. PATENT DOCUMENTS 253,528 A * 2/1882 Haggerty ..... 114/113

OTHER PUBLICATIONS

Schaefer Marine 1988 Catalog No. 20, New Bedford, MA, pp. 3,70,92.*

Harken '97 catalog, Pewaukee, WI, p. 7.*

* cited by examiner

*Primary Examiner*—Stephen Avila

(57) ABSTRACT

A "U" shaped bail attached to a sailboat boom has a roller placed between it and the shackle attaching the sheet to the bail. This allows a smooth transmittal of the sheet load to the boom as the angle and intensity of the sheeting load changes.

2 Claims, 1 Drawing Sheet

LOW FRICTION BOOM TO SHEET ATTACHMENT FOR SAILBOAT

BACK GROUND OF THE INVENTION

1. Field of the Invention

The invention relates to sailboat booms and more particularly, to a device that attaches the sheet, the line that trims the sail, to the boom.

2. Description of the Prior Art

Sailors attach the sheet to the boom usually by some fitting fastened to the bottom of the boom or by a bail which extends under the boom and up each side where it is thru bolted to the boom on the boom's center line. The load and its angle that the sheet exerts on the boom varies to extremes and these loads are often shock loads. If the sheet is attached to the bottom of the boom, it transmits a torsional load to the boom which is very hard on the gooseneck. The bail solves this problem by transmitting the load to the center line of the boom. A bail is typically a stainless steel rod, its ends flattened and fitted with holes for the mounting bolt and bent into a "U" shape to fit the boom. The sheet or sheeting block is attached to the bail with a stainless steel shackle which slides on the bail seeking the angle that the sheet makes with the boom. Under heavy loads, the sliding is not smooth and much wear takes place. The invention solves this problem.

SUMMARY OF THE INVENTION

The invention provides a means of attaching the boom of a sailboat to its sheet, the line that trims the boom, so that as the loads and angles between the boom and the sheet change, the attachment will smoothly adjust with minimum wear and transmit the load to the center line of the boom to minimize torsional loads on the boom's gooseneck.

The device consists of a "U" shaped bail with a hole in each end so that it can be thru bolted to the boom on the boom's center line. A shackle with a roller on its clevis pin is fastened onto the bail so that the roller acts as an interface between the shackle and the bail. When the sheet is attached to the shackle, its load is transmitted to the boom through the roller and bail so that changes in the angle and magnitude of the load are smoothly transferred to the center line of the boom.

It is the object of the invention to provide an inexpensive, easily installed device that provides a low friction, non torquing connection between a sailboat boom and its sheet.

DESCRIPTION OF THE PREFERRED EMBODIMENTS

Figure 1:
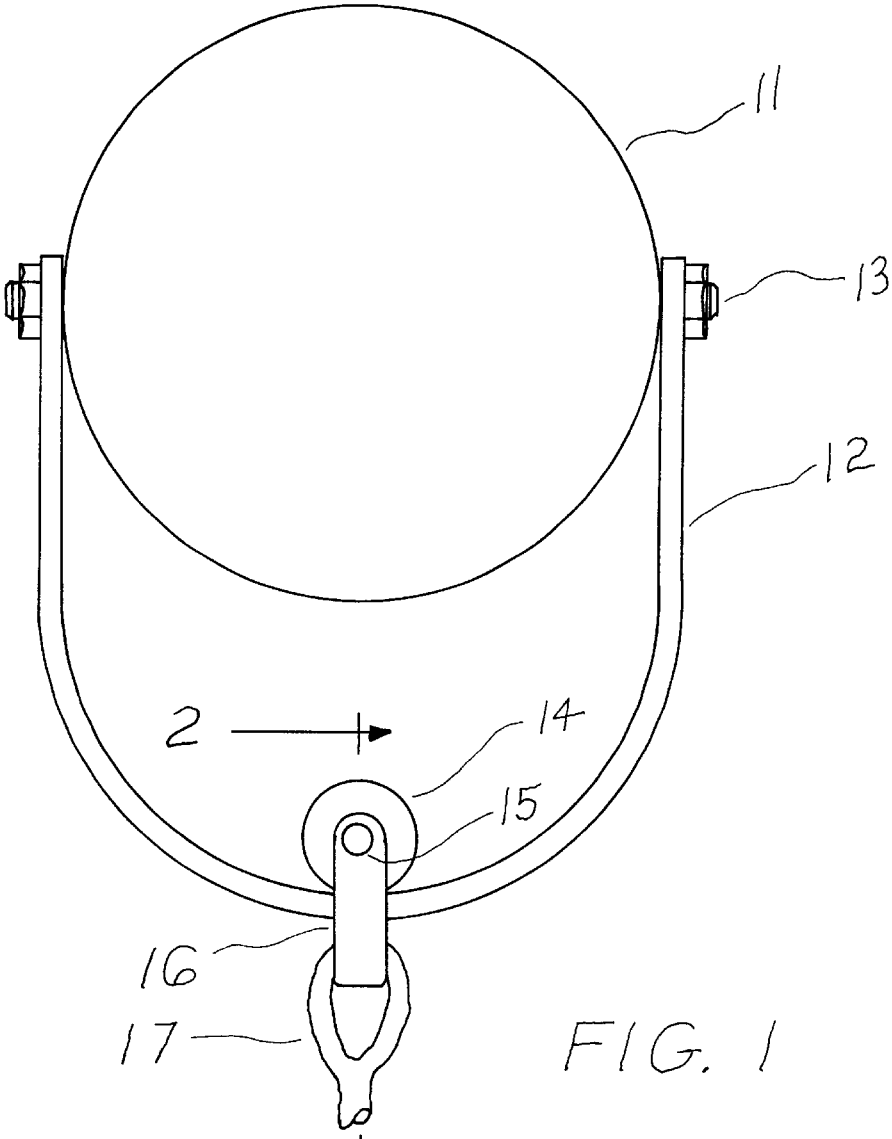
FIG. 1 is a representation of a sailboat boom with a bail and a low friction connecting device which connects the sheet to the bail.

FIG. 1 illustrates a sailboat boom with a bail attached to its center line and a low friction connecting device that connects the sheet to the bail. The view is axial long the boom. A "U" shaped bail 12 is bolted to the center line of boom 11 with a thru bolt 13. A shackle 16 attaches the sheet 17 to the bail 12 through the roller 14 which rotates on the shackle clevis pin 15. No matter what trimming angle the sheet 17 takes with respect to the boom 11, roller 14 will allow shackle 16 to move to a location on bail 12 which keeps the load on the boom 11 from directing any rotational forces to the boom 11.

Figure 2:
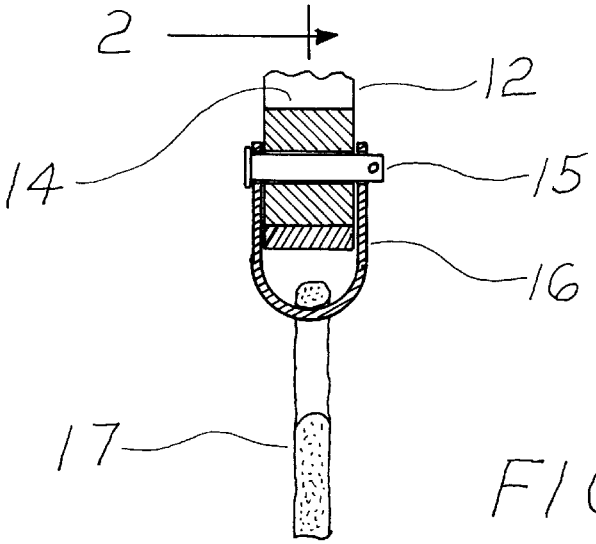
FIG. 2 is a sectional view taken along line 2—2 of FIG. 1 showing details of how the low friction connecting device connects the sheet to the bail.

FIG. 2 shows a sectional view of the low friction connecting device as described in the previous paragraph.

Although only one preferred embodiment of this invention has been disclosed it will be understood that various changes and modifications may be made without departing from the spirit and scope of this invention as defined in the appended claims.

I claim:

1. A low friction boom to sheet attachment for a sailboat comprising:

a "U" shaped bail formed from bar stock with a hole in each end where said bail is attached to the said boom by attachment devices located through said holes and with said bail having a rectangular cross section;

a shackle device with a clevis pin encompassing said bail and oriented with said clevis pin on the inside of said bail and the width of said bail being enough less than the access opening of said shackle to allow unhindered movement of said shackle with respect to said bail; and a roller device of right cylinder shape positioned in contact with inside surface of said bail being mounted on and free to turn on said clevis pin of said shackle device thereby acting as a low friction connection between said shackle device and said bail.

2. A low friction boom to sheet attachment as recited in claim 1, further comprising:

that the length of the diagonal of said rectangle of said bail cross section is greater than said access opening of said shackle causing said shackle to maintain only one positional relationship with respect to said bail.

* * * * *